United States Patent [19]

Lipp et al.

[11] 4,427,395

[45] Jan. 24, 1984

[54] METHOD FOR MAKING A DIPOLAR-DEFLECTING AND QUADRUPOLAR-FOCUSING COLOR-SELECTION STRUCTURE FOR A CRT

[75] Inventors: Steven A. Lipp, Hopewell; Michael P. Adams, Mercerville, both of N.J.

[73] Assignee: RCA Corporation, New York, N.Y.

[21] Appl. No.: 410,962

[22] Filed: Aug. 24, 1982

[51] Int. Cl.[3] ..... H01J 9/233

[52] U.S. Cl. ..... 445/37; 445/47; 430/23

[58] Field of Search ..... 430/23, 312, 313, 318, 430/316; 156/634, 644, 651, 661.1; 313/403; 445/37, 47

[56] References Cited

U.S. PATENT DOCUMENTS

| | | | |
|---|---|---|---|
| 3,786,542 | 1/1974 | Linder | 445/50 |
| 4,160,311 | 7/1979 | Ronde et al. | 445/37 |
| 4,207,490 | 6/1980 | Van der Van | 313/403 |
| 4,311,944 | 1/1982 | Bloom et al. | 315/375 |
| 4,316,126 | 2/1982 | Hockings et al. | 315/375 |

*Primary Examiner*—Kenneth J. Ramsey
*Attorney, Agent, or Firm*—E. M. Whitacre; D. H. Irlbeck; L. Greenspan

[57] ABSTRACT

The novel method comprises (1) producing in one major surface of a metal masking plate an array of substantially-parallel grooves separated by ridges of plate metal, (2) producing in the other of said major surfaces an array of generally rectangular-shaped depressions opposite the grooves and extending only partially through the plate and less than the distances required to connect to said grooves, (3) filling the grooves with an electrically-insulating material, (4) removing the ridges of metal down to depths to connect with the depressions, thereby producing an array of substantially-rectangular apertures through the plate and electrically-insulating strips across the apertures and (5) covering selected surface portions of the electrically-insulating material with an electrically-conducting material. Before step (3), the surface of the grooves are coated with a resistive or semiconductive material, such as black iron oxide.

10 Claims, 6 Drawing Figures

Fig. 1
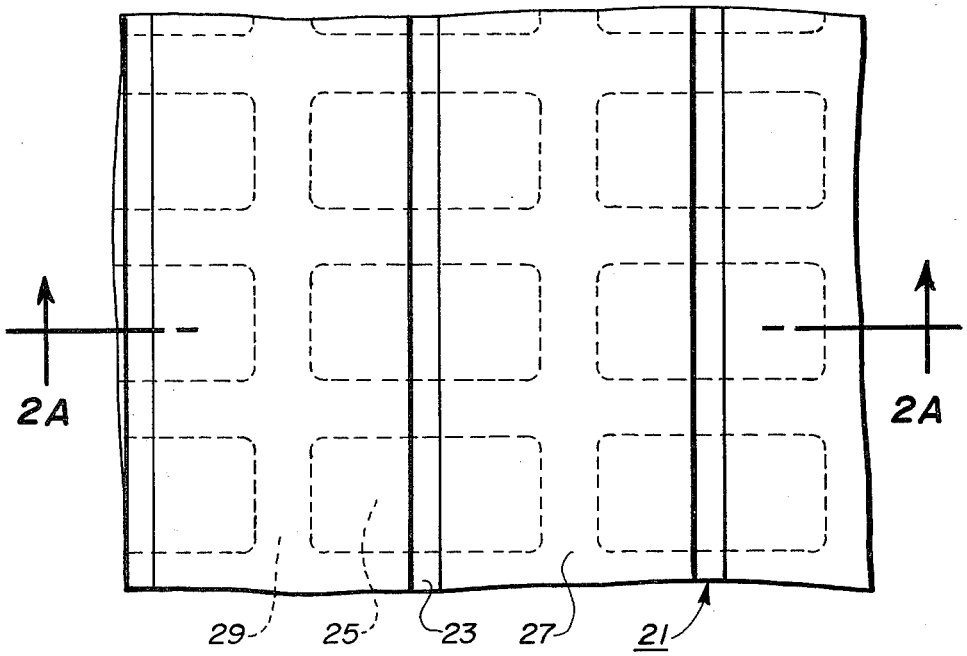
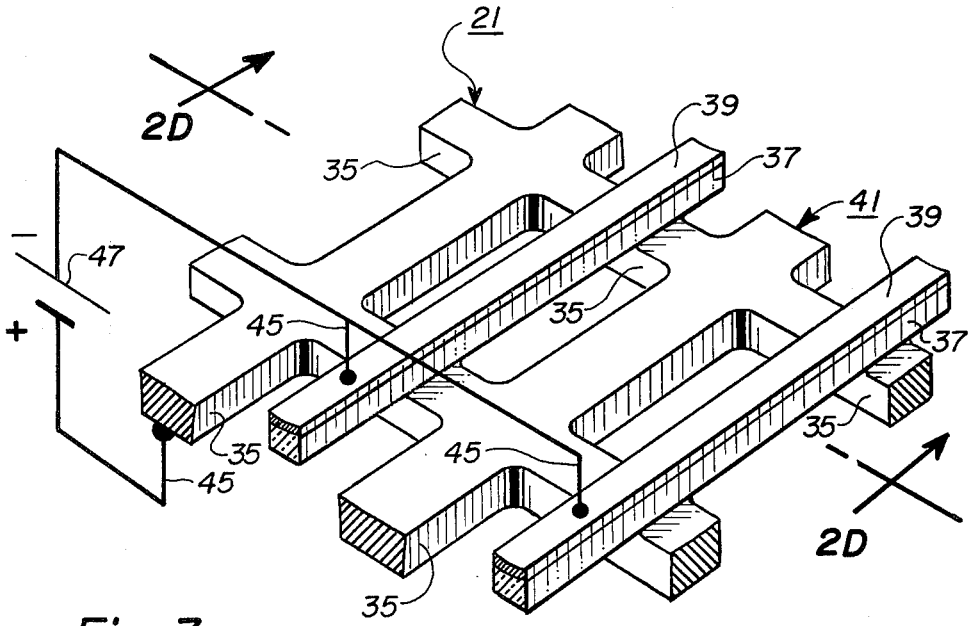
Fig. 3

METHOD FOR MAKING A DIPOLAR-DEFLECTING AND QUADRUPOLAR-FOCUSING COLOR-SELECTION STRUCTURE FOR A CRT

BACKGROUND OF THE INVENTION

This invention relates to a novel method of making a dipolar-deflecting and quadrupolar-focusing color-selection structure for a CRT (cathode-ray tube).

A commercial shadow-mask-type color television picture tube, which is a CRT, comprises generally an evacuated envelope having therein a target comprising an array of phosphor elements of three different emission colors arranged in color groups in cyclic order, means for producing three convergent electron beams directed towards the target, and a color-selection structure including a masking plate between the target and the beam-producing means. The masking plate shadows the target, and the differences in convergence angles permit the transmitted portions of each beam, or beamlets, to select and excite phosphor elements of the desired emission colors. At about the center of the color-selection structure, the masking plate of a commercial CRT intercepts all but about 18% of the beam current; that is, the plate is said to have a transmission of about 18%. Thus, the area of the apertures of the plate is about 18% of the area of the masking plate. Since there are no focusing fields present, a corresponding portion of the target is excited by the beamlets of each electron beam.

Several methods have been suggested for increasing the transmission of the masking plate; that is, increasing the area of the apertures with respect to the area of a plate, without substantially increasing the excited portions of the target area. In one approach, the apertures are arranged in columns opposite substantially-parallel phosphor stripes in the target. Each aperture in the masking plate is enlarged and split into two adjacent windows by a conductor. The two beamlets passing through adjacent windows are deflected towards one another, and both beamlets fall on substantially the same area of the target. In this approach, the transmitted portions of the beams are also focused in one transverse direction and defocused in the orthogonal transverse direction.

One family of CRTs employing such a combined deflecting-and-focusing color-selection structure includes, as normally viewed, a target comprising a mosaic of vertical phosphor stripes of three different emission colors arranged cyclically in triads (groups of three different stripes), means for producing three convergent horizontally in-line electron beams directed towards the target, and a color-selection structure located adjacent and closely spaced from the target. The color-selection structure comprises a metal-masking plate having therein an array of substantially-rectangular apertures arranged in vertical rows and an array of narrow vertical conductors insulatingly spaced and supported from one major surface of the masking plate, with each conductor substantially centered over the apertures of one of the columns of apertures. Each conductor is unsupported and uninsulated over each aperture. Viewed from the electron-beam-producing means, the conductors divide each aperture into two essentially-equal horizontally-coadjacent windows.

When operating this latter device, the narrow vertical conductors are electrically biased with respect to the masking plate, so that the beamlets passing through each of the windows of the same aperture are deflected horizontally toward the positively-biased side of the window. Simultaneously, because of the quadrupole-like focusing fields established in the windows, the beamlets are focused (compressed) in one direction of the phosphor stripes and defocused (stretched) in the other direction. The spacings and voltages are so chosen to form an array of electrostatic lenses that also deflect adjacent pairs of beamlets to fall on the same phosphor stripe of the target. The convergence angle of the beam that produces the beamlets determines which stripe of the triad is selected.

In a typical color-selection structure of this type, the apertures may be about 0.625 mm (25 mils) wide on about 0.760 mm (30 mils) centers horizontally and about 0.300 mm (12 mils) high on about 0.450 mm (18 mils) centers vertically, and the conductors may be about 0.075 mm (3 mils) wide and spaced about 0.050 mm (2 mils) from the plate. Because of the small and precise sizes required of the apertures and of the strips, special techniques must be employed to fabricate structures of this type at reasonable cost. Several methods have been suggested previously. But, each prior method appears to be too costly and may not produce an adequate yield of acceptable structures.

SUMMARY OF THE INVENTION

The novel method for making a dipolar-deflecting and quadrupolar-focusing color-selection structure for a CRT comprises (a) providing a metal plate having two opposed major surfaces, (b) producing in one of the major surfaces an array of substantially-parallel grooves separated by ridges of metal therebetween, (c) producing in the other of said surfaces an array of shaped depressions opposite the grooves, extending only partially through the plate and less than the distances required to connect to said grooves, the depressions being substantially wider than the widths of the grooves, (d) filling the grooves with an etch-resistant, electrically-insulating material, (e) removing the ridges of metal from the one surface down to depths to connect with the depressions, thereby producing an array of shaped apertures through the plate and electrically-insulating strips across the apertures, and (f) covering selected surface portions of said electrically-insulating strips with a coating of electrically-conducting material, said electrically-conducting coating being spaced from the plate.

In the preferred embodiment of the novel method, relatively with ridges, relatively narrow grooves and depressions of the desired shape are made at the same time by producing temporary acid-resistant stencils, as by a photographic technique, on both major surfaces of the plate, and then etching the plate through both stencils. At this point, the surfaces of the grooves are coated with a semiconductive or resistive material, such as black iron oxide. This coating is retained on the surfaces of the electrically-insulating strips in the product of the novel method. Then, the grooves are filled with organic polymeric electrically-insulating material. Then, the relatively-wide ridges are removed as by etching, producing an array of apertures of the desired shape with relatively-narrow strips of electrically-insulating material across the apertures. Electrically-conducting coatings are applied to the surfaces of the strips of electrically-insulating material.

BRIEF DESCRIPTION OF THE DRAWINGS

FIG. 1 is a plan view of a fragment of a metal plate having acid-resistant stencils on both major surfaces thereof during the practice of the novel method, one of the stencils having an array of substantially-rectangular openings therein.

FIG. 3 is a perspective view of a fragment of a color-selection structure prepared by the novel method.

DETAILED DESCRIPTION OF THE PREFERRED EMBODIMENT

Figure 2A:
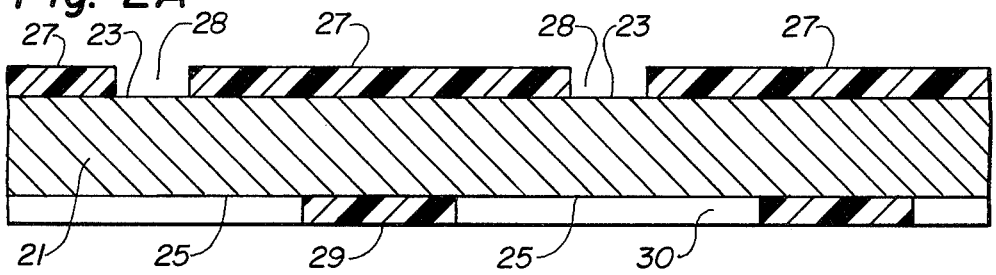
FIGS. 2A through 2D are a series of sectional elevational views along section lines 2A—2A of the metal plate of FIG. 1 and viewed through said openings during the fabrication into a color-selection structure according to the novel method.

The novel method for making a dipolar-deflecting and quadrupolar-focusing color-selection structure for a CRT is illustrated by the sequence of steps shown in FIGS. 2A through 2D. The first step includes providing a metal sheet or plate 21 having two opposed major surfaces 23 and 25 as shown in FIGS. 1 and 2A. An upper acid-resistant stencil 27 is produced on the upper surface 23, and a lower acid-resistant stencil 29 is produced on the lower surface 25. The upper stencil 27 consists essentially of relatively-wide substantially-parallel, acid-resistant strips of acid-resistant material separated by relatively-narrow upper open areas 28 (which expose the upper surface 23). The lower stencil 29 consists essentially of a coating of acid-resistant material having therein an array of substantially-rectangular lower open areas 30 (which expose the lower surface 25) arranged in substantially-parallel columns which are centered opposite the narrow areas 28 of the first stencil 27. FIG. 2A is a sectional view of the structures shown in FIG. 1 along section lines 2A—2A across the strips and upper open areas 28 of the first stencil 27 and through the lower open areas 30 of the second stencil 29.

The metal plate 21 is preferably about 0.15 mm (6 mils) thick, although other thicknesses may be used. The plate 21 is of low-carbon cold-rolled steel. Other metals or metal alloys, such as a copper alloy containing about 2-weight-percent beryllium and known as Berylco 25, may be used. The stencils 27 and 29 are prepared by a photographic technique using a photoresist. Although any photoresist may be used, the photoresist used in this example is dichromate-sensitized casein. Alternatively, the photoresist may be a precast sheet marketed under the name of Riston 210R by E. I. du Pont, Wilmington, Del. Each precast photoresist sheet is sandwiched between a sheet of mylar and a sheet of polyethylene. In use, the polyethylene sheet is stripped off, and then a photoresist sheet is laminated to each major surface 23 and 25 respectively, with the mylar sheets covering the photoresist sheets or layers. Each of the photoresist layers 27 and 29 is exposed to an image of actinic radiation, as by contact exposure through a template or photographic working plate, whereby there are produced in each layer regions which are more soluble and regions which are less soluble than a particular developer. The photoresist layers 27 and 29 in this example, being negative acting, are insolubilized by the exposing actinic light.

Next, the photoresist layers 27 and 29 on both major surfaces of the plate are developed, leaving a first upper stencil 27 having grooved-defining upper open areas 28 therein separated by acid-resistant strips, and a second lower stencil 29 having therein aperture-defining lower upon areas 30 centered opposite the upper open areas 28 of the upper stencil 27. The preferred developer for casein photoresist is water. Where the photoresist is Riston, the preferred developer is an aqueous liquid marketed under the name Riston II developer 2000 by E. I. du Pont, Wilmington, Del. The acid-resistant strips of the upper stencil are about 0.712 mm (27 mils) wide on about 0.75 mm (30 mils) centers and extend about the length of the plate 21.

Figure 2B:
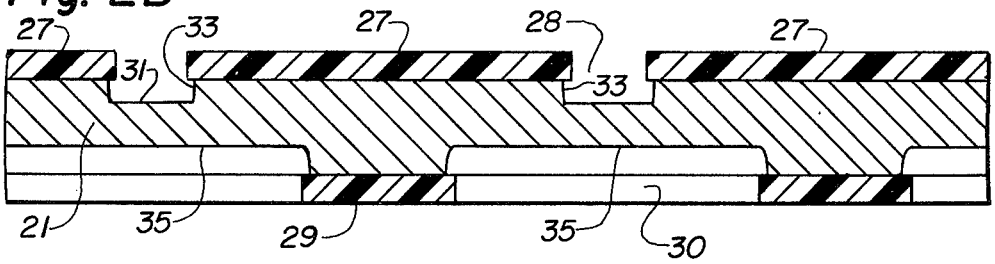

Next, as shown in FIGS. 2B, the metal plate 21 is etched by applying a suitable etchant through the open areas 28 and 30 of both the upper and lower stencils 27 and 29. An array of substantially-parallel relatively-narrow grooves 31 about 0.075 mm (3 mils) wide and about 0.050 mm (2 mils) deep on about 0.75 mm (30 mils) centers separated by relatively-wide ridges 33 is produced in the upper surface 23 of the plate. An array of substantially-rectangular depressions 35 about 0.625 mm (25 mils) by 0.300 mm (12 mils) on 0.75 mm (30 mils) by 0.45 mm (18 mils) centers are etched in the lower surface 25 of the plate opposite the ridges 33 about 0.075 mm (3 mils) deep. The preferred etchant is aqueous 50-weight-percent ferric-chloride solution containing hydrochloric acid. After the grooves 31 and the depressions 35 are etched, the external surfaces of the plate 21 are rinsed with deionized water to remove any residual etchant thereon.

Figure 2C:
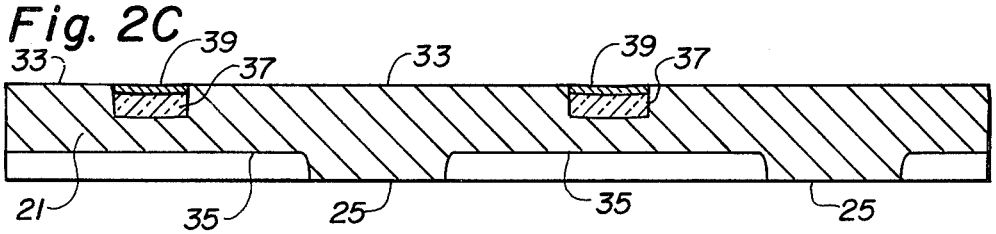

Next, as shown in FIG. 2C, both the upper and lower stencils 27 and 29 are removed by any of the methods known in the art. Where a casein photoresist is used, it is preferred to apply a hot aqueous alkali solution to the stencils to solubilize them.

The surfaces of the grooves 31 are coated with a semiconducting or a resistive material, such as black iron oxide, which coating is retained on the surfaces of the electrically-insulating strips in the final structure. The purpose of this coating is to limit the accumulation of electrostatic charge on the surfaces of the electrically-insulating strips during the operation of the CRT. The coating can be applied to the groove surfaces before the stencils are removed from the plate 21. Alternatively, a coating can be applied to selected surface areas after the stencils are removed. Or, after the stencils are removed, the coating can be produced over the entire surface area as by baking the steel sheet in a steam-and-nitrogen atmosphere to produce a continuous black oxide coating. If the coating is applied to the entire surface, the coating must be removed from the surface areas around the grooves before the final etching step. This can be accomplished, for example, by filling the grooves with electrically-insulating material as described below, and then dipping the partially-completed structure briefly in a hydrochloric acid solution (typically 50 volume percent concentrated acid and 50 percent water).

Then, the grooves 31 are filled with electrically-insulating solid material. Inorganic material or organic polymeric material which can tolerate subsequent processing can be used. In this example, a polyimide, such as Pyralin PI 2550 marketed by E. I. du Pont, Wilmington, Del., is doctor bladed into the grooves producing an electrically-insulating layer 37. Other methods may be used for filling the grooves. Finely-divided silica, alumina or glass may be added to the polyimide to alter its coating characteristics. The thickness of the electrically-insulating layer 37 is determined in part by the depths of the grooves 31. Also, the polyimide exhibits considerable shrinkage upon curing, leaving a depression above it which should be considered in the design of the structure. Several applications of polyimide may be used to compensate for at least part of the shrinkage.

Next, as shown in FIG. 2C, a coating 39 of an electrically-conducting material is applied to the tops of the electrically-insulating layer 37. The electrically-conducting material can be doctor bladed as a layer 39 into the depression left above the cured electrically-insulating layer 37. The preferred material is a mixture of metallic-silver particles mixed with Pyralin, supra. Carbon, other metals, or metal oxides that are electrically conducting may substitute for metallic silver. Alternatively, the electrically-conducting layer 39 may be produced on the electrically-insulating layer 37 as the last step in the novel method. In those cases, the mixture of conducting particles and Pyralin may be roller-coated on tops of the insulating strips 37. Multiple applications by roller-coating may be used to build up the desired thickness. Alternatively, in those cases, the tops of the strips 37 may be metalized; that is, metal stripes 53 may be deposited on the strips and spaced from the metal plate 21. Metalization may be accomplished by vapor-deposition of a metal, such as aluminum, at low ambient pressures. In other alternatives, a conductive paste may be applied, as by brushing, over the strips and then cured; or, the conductive stripes can be cast over the ridges; or, prefabricated conductive metal strips may be transferred from a temporary substrate to the tops of the electrically-insulating strips.

Figure 2D:
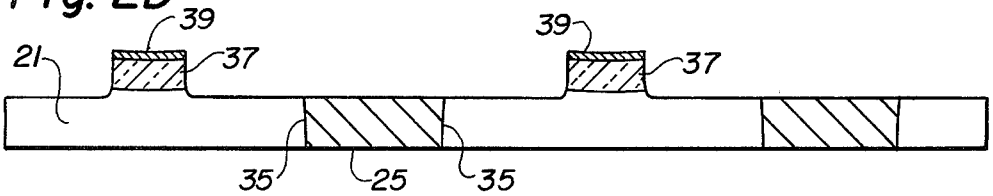

After the electrically-insulating layer 37 in the grooves is produced (with or without the conducting layer 39 thereon), the upper surface of the plate 21 is etched using the electrically-insulating layer 37 as an etch-resistant stencil. This second etching step etches through the plate 21, removing the relatively wide ridges 33 and connecting with the depressions 35, thereby producing substantially-rectangular apertures through the plate 21 in substantially-parallel columns and electrically-insulating strips 37 across the apertures as shown in FIG. 2D.

The finished product is shown in the perspective view of a fragment thereof in FIG. 3. FIG. 2D is a sectional view of the structure shown in FIG. 3 viewed through the apertures along section lines 2D—2D in FIG. 3. The color-selection structure comprises a metal masking plate 41 having an array of apertures therethrough formed by the depressions 35. The apertures are arranged in substantially-parallel columns, the spacing being related to the spacings of the luminescent stripes of the viewing screen (not shown) of the CRT in which the structure is to be used. There is an array of substantially-parallel relatively-narrow conductors 39 on insulating strips 37 which are supported on the plate 21. The conductors 39 are located down the centers of the columns of apertures 35.

The novel color-selection structure may be used in a color television picture tube substantially as described previously. To this end, the novel color-selection structure includes connection means 45 for applying a voltage from a voltage source 47 between the masking plate 21 and the array of conductors 39. To obtain horizontal focusing and vertical defocusing, the masking plate is electrically positive with respect to the array of conductors 39. The voltage differences between 200 and 1200 volts are practical provided the electrical-insulating layer 37 can withstand the electric field produced by this voltage difference. Two different modes of operation are described in U.S. Pat. No. 4,207,490 issued June 10, 1980 to R. F. L. M. Van der Ven and U.S. Pat. No. 4,316,126 issued Feb. 16, 1982 to E. F. Hockings et al.

What is claimed is:

1. In a method for making a dipolar-deflecting and quadrupolar-focusing color-selection structure for a cathode-ray tube comprising A. providing a metal plate having two opposed major surfaces, B. producing an array of substantially-parallel grooves in one of said surfaces, said grooves being spaced by substantially-parallel ridges of plate metal, C. producing in the other of said surfaces an array of shaped depressions opposite said grooves and extending only partially through said plate, and less than the distances required to connect to said grooves, said depressions being substantially wider than the widths of said grooves, D. filling said grooves with an etch-resistant, electrically-insulating material, E. removing said ridges of metal from said one of said surfaces down to depths to connect with said shaped depressions, thereby producing an array of shaped apertures through said plate and electrically-insulating strips across the apertures, F. and covering selected surface portions of said electrically-insulating material with a coating of electrically-conducting material, said coating of electrically-conducting material being spaced from said plate, wherein, after step C and before step D, the surfaces of said grooves are coated with a resistive or semi-conductive material.

2. The method defined in claim 1 wherein, in step B, said ridges are relatively wide and said grooves are relatively narrow.

3. The method defined in claim 1 wherein step B comprises (i) producing a first etch-resistant stencil on said one major surface of said plate, said first stencil including therein substantially-parallel, strip-like, groove-defining open areas separated by strips of etch-resistant material, (ii) etching said one major surface through said strip-like open areas to produce said grooves (iii) and then removing said first stencil.

4. The method defined in claim 1 wherein step C comprises (i) producing a second etch-resistant stencil on the other major surface of said plate, said second stencil having therein open, substantially-rectangular depression-defining areas arranged in substantially parallel columns opposite said ridges, (ii) etching depressions only partially through said plate by applying etchant through said aperture-defining areas of said second stencil (iii) and then removing said second stencil.

5. The method defined in claim 1 wherein the surfaces of said grooves are coated with black iron oxide.

6. The method defined in claim 1 wherein said electrically-insulating material consists essentially of an organic polymeric substance, and said electrically-conducting material consists essentially of electrically-conducting particles in an organic polymeric substance.

7. The method defined in claim 1 wherein step D includes doctor-blading an electrical insulator into said grooves.

8. The method defined in claim 1 wherein step F comprises doctor-blading an electrical conductor into said grooves on top of said electrically-insulating material prior to step E.

9. The method defined in claim 1 wherein step F comprises roller-coating an electrical conductor on top of said electrically-insulating material subsequent to step E.

10. The method defined in claim 1 wherein step F comprises vapor-depositing aluminum metal on top of said electrically-insulating material subsequent to step E.

* * * * *